US009605692B2

(12) United States Patent
Kopecek

(10) Patent No.: US 9,605,692 B2
(45) Date of Patent: Mar. 28, 2017

(54) LOCKING ROTARY ACTUATOR

(71) Applicant: Woodward, Inc., Fort Collins, CO (US)

(72) Inventor: Joseph Thomas Kopecek, Santa Clara, CA (US)

(73) Assignee: Woodward, Inc., Fort Collins, CO (US)

( * ) Notice: Subject to any disclaimer, the term of this patent is extended or adjusted under 35 U.S.C. 154(b) by 422 days.

(21) Appl. No.: 14/503,734

(22) Filed: Oct. 1, 2014

(65) Prior Publication Data

US 2016/0097407 A1 Apr. 7, 2016

(51) Int. Cl.

| | |
|---|---|
| ***F01C 9/00*** | (2006.01) |
| ***F15B 15/26*** | (2006.01) |
| ***F15B 15/12*** | (2006.01) |

(52) U.S. Cl.

CPC ..... *F15B 15/261* (2013.01); *F15B 15/12* (2013.01); *F15B 2015/267* (2013.01); *F15B 2015/268* (2013.01)

(58) Field of Classification Search

CPC ... F15B 15/261; F15B 15/12; F15B 2015/267
USPC ..... 92/23, 120–125
See application file for complete search history.

(56) References Cited

U.S. PATENT DOCUMENTS

| | | | |
|---|---|---|---|
| 2,564,206 | A | 8/1951 | Johnson |
| 3,174,599 | A | 3/1965 | Spyridakis et al. |
| 3,251,278 | A | 5/1966 | Royster |
| 3,318,201 | A | 5/1967 | Blake |
| 3,426,652 | A | 2/1969 | Blake |
| 3,477,333 | A | 11/1969 | Yamamoto et al. |
| 3,722,641 | A | 3/1973 | Kusiak |
| 4,114,737 | A | 9/1978 | Fukui |

(Continued)

FOREIGN PATENT DOCUMENTS

| | | |
|---|---|---|
| DE | 2418915 | 10/1975 |
| DE | 10207415 | 9/2003 |

(Continued)

OTHER PUBLICATIONS

International Search Report and Written Opinion of the International Searching Authority issued in International Application No. PCT/US2015/052852 on Dec. 10, 2015; 14 pages.

*Primary Examiner* — Thomas E Lazo
*Assistant Examiner* — Daniel Collins
(74) *Attorney, Agent, or Firm* — Fish & Richardson P.C.

(57) ABSTRACT

The subject matter of this specification can be embodied in, among other things, a locking apparatus for a rotary actuator includes an outer housing comprising a cylindrical interior surface having a recess. A rotor is disposed within the outer housing. The rotor has an interior cavity and a port extending radially from the interior cavity to the cylindrical exterior surface. A piston is disposed for reciprocal movement within the interior cavity between a first position and a second position and includes a first portion having a first thickness, a second portion having a second thickness larger than the first thickness. A key is disposed for radially reciprocal movement within the port and includes a radially proximal end and a radially distal end. The radially proximal end contacts the first portion and the radially distal end does not extend into the recess when the piston is in the first position.

15 Claims, 6 Drawing Sheets

(56) References Cited

U.S. PATENT DOCUMENTS

| | | | |
|---|---|---|---|
| 4,143,838 | A | 3/1979 | Holladay |
| 4,166,402 | A | 9/1979 | Rayfield |
| 4,296,895 | A | 10/1981 | Pazmany |
| 4,404,714 | A | 9/1983 | Duran |
| 4,795,110 | A | 1/1989 | Lang |
| 5,007,762 | A | 4/1991 | Duran |
| 5,056,418 | A | 10/1991 | Granger |
| 5,098,042 | A | 3/1992 | Viale |
| 5,607,250 | A | 3/1997 | Tatterson et al. |
| 5,658,087 | A | 8/1997 | Butkovich et al. |
| 5,950,997 | A | 9/1999 | Metz |
| 6,032,920 | A | 3/2000 | Takahashi et al. |
| 6,152,645 | A | 11/2000 | Sanford |
| 6,186,443 | B1 | 2/2001 | Shaffer |
| 6,206,432 | B1 | 3/2001 | Kamiyama |
| 6,224,013 | B1 | 5/2001 | Chisolm |
| 6,299,101 | B1 | 10/2001 | Schroppel et al. |
| 6,928,931 | B1 | 8/2005 | Biserod |
| 6,948,685 | B2 | 9/2005 | Hawthorne |
| 6,971,351 | B2 * | 12/2005 | Kinugawa ..... F01L 1/022 123/90.15 |
| 7,125,058 | B2 | 10/2006 | Hawthorne |
| 7,207,518 | B2 | 4/2007 | Alculumbre et al. |
| 7,316,370 | B2 | 1/2008 | Sankovic et al. |
| 7,762,739 | B2 | 7/2010 | Blanchard |
| 7,930,971 | B2 | 4/2011 | Werkhoven |
| 2003/0051950 | A1 | 3/2003 | Harvey |
| 2003/0140778 | A1 | 7/2003 | Vincent |
| 2004/0182235 | A1 | 9/2004 | Hart |
| 2006/0278754 | A1 | 12/2006 | Sankovic et al. |
| 2014/0238230 | A1 | 8/2014 | Kim et al. |

FOREIGN PATENT DOCUMENTS

| | | |
|---|---|---|
| EP | 0441669 | 8/1991 |
| EP | 1191271 | 3/2002 |

* cited by examiner

LOCKING ROTARY ACTUATOR

TECHNICAL FIELD

This instant specification relates to rotary actuators with locking mechanisms.

BACKGROUND

Rotary hydraulic actuators of various forms are currently used in industrial mechanical power conversion applications. This industrial usage is commonly for applications where continuous inertial loading is desired without the need for load holding for long durations, e.g. hours, without the use of an external fluid power supply. Aircraft flight control applications generally implement loaded positional holding, for example, in a failure mitigation mode, using the blocked fluid column to hold position.

In certain applications, such as primary flight controls used for aircraft operation, positional accuracy in load holding by rotary actuators is desired. Positional accuracy can be improved by minimizing internal leakage characteristics inherent to the design of rotary actuators. However, it can be difficult to provide leak-free performance in typical rotary hydraulic actuators, e.g., rotary "vane" or rotary "piston" type configurations as it requires substantially perfect sealing of the blocked hydraulic fluid in order to maintain the angular position of the actuator. Furthermore, any single failure of a seal will result in a complete loss of locking capability of the actuator.

SUMMARY

In general, this document rotary actuators with locking mechanisms.

In a first aspect, a locking apparatus for a rotary actuator includes an outer housing comprising a cylindrical interior surface having a radial recess having at least one circumferential end formed therein. A rotor is disposed within the outer housing and includes a cylindrical exterior surface rotatable within the cylindrical interior surface. The rotor has an axial interior cavity and a port disposed to be capable of rotational alignment with the radial recess and extending radially from the axial interior cavity to the cylindrical exterior surface. A piston is disposed for axially reciprocal movement within the axial interior cavity between a first position and a second position and includes a first portion having a first thickness, a second portion having a second thickness larger than the first thickness, and a piston bevel extending axially from the first portion to the second portion. A key is disposed for radially reciprocal movement within the port and includes a radially proximal end having a first key bevel complementary to the piston bevel, and a radially distal end. A body extends from the radially proximal end to the radially distal end such that the radially proximal end contacts the second portion and the radially distal end extends into the radial recess when the piston is in the second position, and the radially proximal end contacts the first portion and the radially distal end does not extend into the radial recess when the piston is in the first position.

Various embodiments can include some, all, or none of the following features. The circumferential end can have a housing bevel extending circumferentially from the radial recess to the cylindrical interior surface, and the radially distal end has at least one second key bevel complementary to the housing bevel. The rotary actuator can also include an axial spring in biasing contact with the piston. The axial spring can be configured to urge the piston into the first position or the second position. The piston can also include at least one seal between at least one of the first portion and a radially interior wall of the axial interior cavity, and the second portion and the radially interior wall of axial interior cavity. The rotary actuator can include a pressure chamber defined by the axial interior cavity, the piston, and the seal, the pressure chamber being configured to selectably apply fluid pressure to the piston to urge reciprocal axial movement of the piston within the axial interior cavity.

In a second aspect, a method for selectively locking a rotary actuator includes providing a rotary actuator having an outer housing comprising a cylindrical interior surface having a radial recess having at least one circumferential end formed therein, a rotor disposed within the outer housing and comprising, a cylindrical exterior surface rotatable within the cylindrical interior surface, an axial interior cavity, and a port disposed to be capable of rotational alignment with the radial recess and extending radially from the axial interior cavity to the cylindrical exterior surface. The rotary actuator also includes a piston disposed for axially reciprocal movement within the axial interior cavity between a first position and a second position and includes a first portion having a first thickness, a second portion having a second thickness larger than the first thickness, and a piston bevel extending axially from the first portion to the second portion. The rotary actuator includes a key disposed for radially reciprocal movement within the port and includes a radially proximal end having a first key bevel complementary to the piston bevel, a radially distal end, and a body extending from the radially proximal end to the radially distal end such that the radially proximal end contacts the second portion and the radially distal end extends into the radial recess when the piston is in the second position, and the radially proximal end contacts the first portion and the radially distal end does not extend into the radial recess when the piston is in the first position. The method also includes contacting the first portion with the radially proximal end, moving by an external force the piston from the first position toward the second position, contacting the piston bevel with the key bevel, urging by movement of the piston and contact between the first key bevel and the piston bevel partial radial extension of the key through the port and partial extension of the radially distal end into the radial recess, contacting the second portion with the radially proximal end, preventing radial retraction of the key through the port and escapement of the radially distal end from the radial recess, and contacting by the radially distal end the circumferential end.

Various implementations can include some, all, or none of the following features. The method can also include contacting the second portion with the radially proximal end, urging by an external force the piston from the second position toward the first position, allowing radial retraction of the key through the port and escapement of the radially distal end from the radial recess, and contacting the first portion with the radially proximal end. The at least one of the circumferential ends can have a housing bevel extending circumferentially from the radial recess to the cylindrical interior surface, and the radially distal end can have at least one second key bevel complimentary to the housing bevel, and the method can also include rotating the housing relative to the rotor, the key, and the piston, contacting one of the circumferential ends to a complementary one of the second key bevels, urging by the contact between the circumferential end to the complimentary one of the second key bevels radial retraction of the key through the port and ejection of the radially distal end from the radial recess, contacting the piston bevel with the key bevel, and urging by contact between the key bevel and the piston bevel movement of the piston from the second position to the first position. The rotary actuator can also include an axial spring in biasing contact with the piston. The axial spring can be configured to urge the piston into the first position or the second position. The piston can include at least one seal between at least one of the first portion and the axial interior cavity, and the second portion and the axial interior cavity. The rotary actuator can include a pressure chamber defined by the axial interior cavity, the piston, and the seal, the pressure chamber being configured to selectably apply fluid pressure to the piston to urge reciprocal axial movement of the piston within the axial interior cavity. Moving the piston from the first position toward the second position can include applying a fluid pressure to the pressure chamber. Moving the piston from the first position toward the second position can include relieving a fluid pressure within the pressure chamber.

The systems and techniques described here may provide one or more of the following advantages. First, a system as disclosed herein can provide improved position-holding capability. Second, the system can provide a fail-safe mechanism that can provide position-holding capability in event of loss of actuation fluid pressure or external or internal leakage failures. Furthermore, the techniques shown provide a robust mechanical lock that has high external load (torque) carrying capability. The system has an additional advantage in that visual or electrical means of indication of lock position may easily be incorporated for safety critical applications.

The details of one or more implementations are set forth in the accompanying drawings and the description below. Other features and advantages will be apparent from the description and drawings, and from the claims.

DETAILED DESCRIPTION

This document describes systems and techniques for locking rotary actuators. In general, the rotary actuators described herein include a rotor that rotates relative to an outer housing. The rotor includes a mechanism that can be actuated to cause one or more keys to extend radially from the rotor. The keys extend into axial grooves (non-circumferential recesses) formed in the inner diameter of the outer housing. The extended keys become reversibly trapped within the recesses and mechanically limit or prevent rotation of the rotor relative to the outer housing. In an example aircraft application, the rotor may be configured to control the position of a control surface (e.g., a flap, rudder, or aileron) relative to a wing to which the outer housing is attached, and in the locked configuration the locking rotary actuator can maintain a relative position between the control surface and the wing.

Figure 1A:
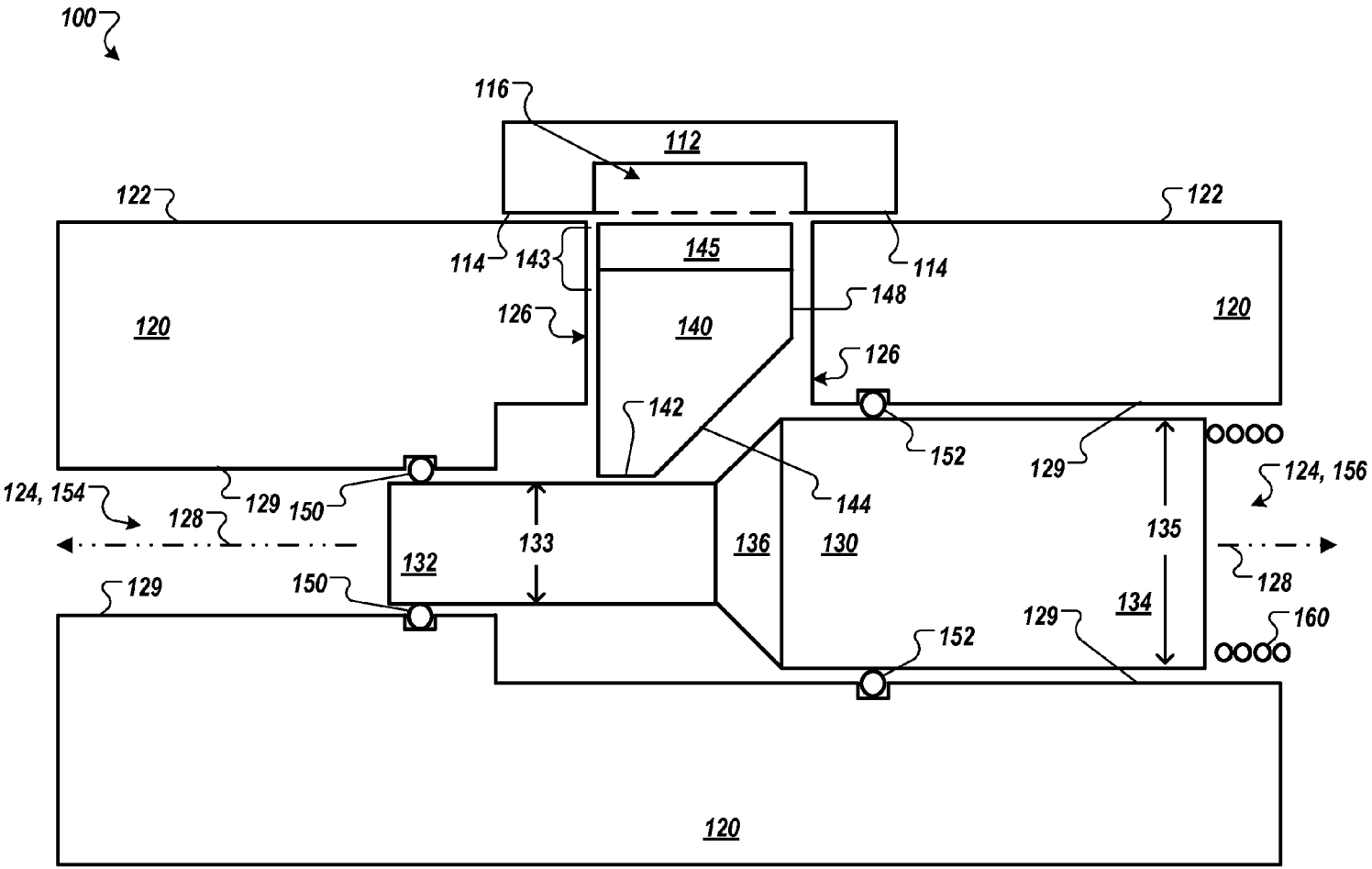
FIGS. 1A and 1B are cross-section side and end diagrams that show an example of a locking rotary actuator in an unlocked configuration.
Figure 1B:
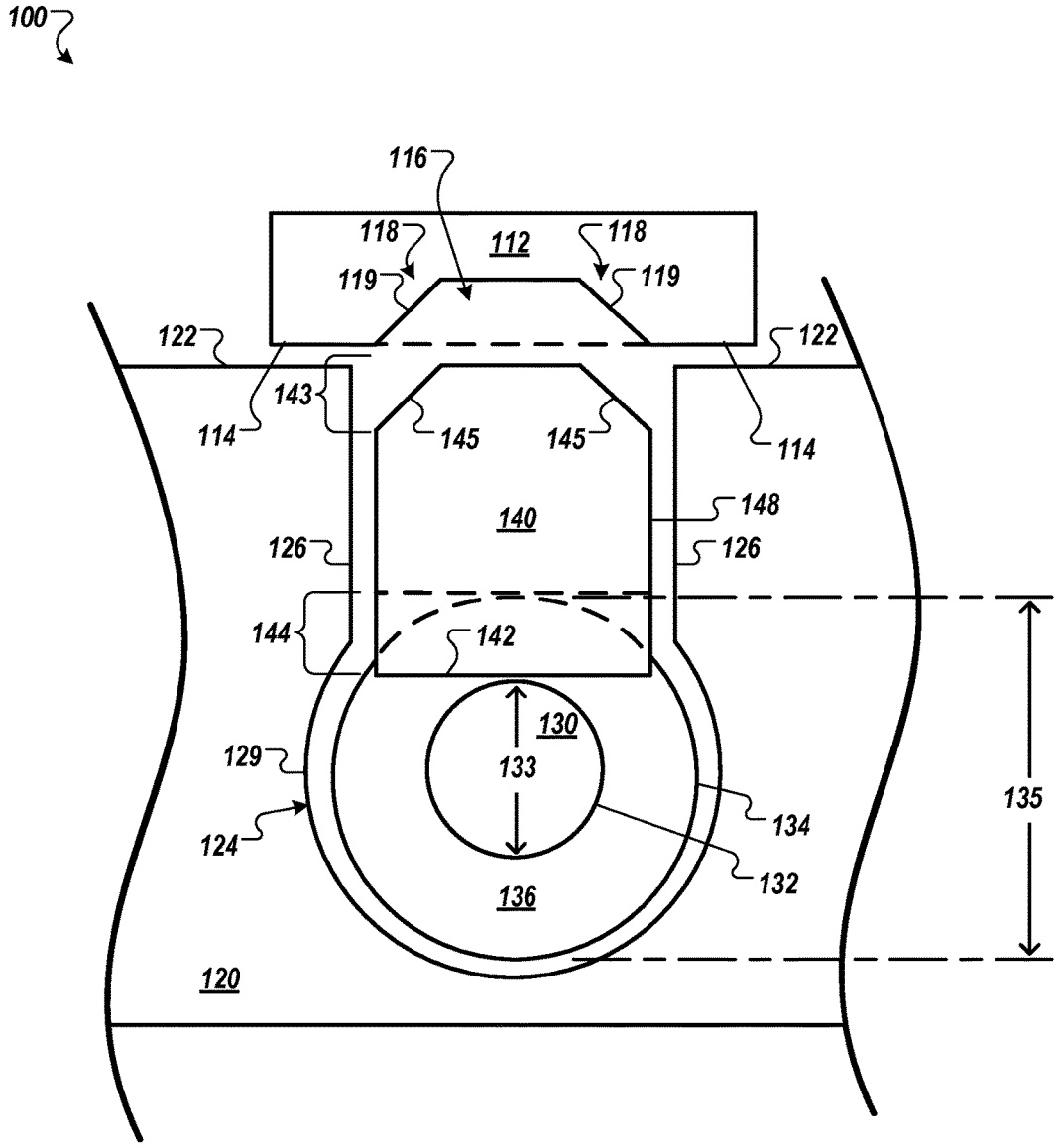

FIGS. 1A and 1B are axial cross-section side and radial end diagrams that show an example of a locking rotary actuator 100 in a first configuration (e.g., an unlocked configuration). In some embodiments, the actuator 100 can be configured to actuate components of an aircraft, spacecraft, marine craft, land vehicle, or any other appropriate form of vehicle.

The example locking rotary actuator 100 includes an outer housing 112. The outer housing 112 includes a cylindrical interior surface 114. A radial recess with an axial length 116 is formed in a portion of the cylindrical interior surface 114. Referring now to FIG. 1B, the radial recess 116 has at least one radially angled circumferential end 118 forming an axial end with respect to the circumferential orientation of the cylindrical interior surface 114. In some embodiments, the outer housing 112 may include multiple ones of the radial recess 116 arranged radially along the cylindrical interior surface 114.

Referring again to FIGS. 1A and 1B, the example locking rotary actuator 100 includes a rotor 120. The rotor 120 is disposed within the outer housing 112, and includes a cylindrical exterior surface 122. The cylindrical exterior surface 122 is rotatable within the cylindrical interior surface 114. In some embodiments, the rotor 120 may be a moving part, e.g., the outer housing 112 may be affixed to an external platform or surface, or may otherwise provide a relative frame of reference for motion of the rotor 120. In some embodiments, the rotor 120 may be a stator or other relatively non-moving part, e.g., the rotor 120 may be affixed to an external platform or surface, or may otherwise provide a relative frame of reference for motion of the outer housing 112. For example, the rotor may be held substantially still, and the actuator 100 may be actuated to cause the outer housing 112 to at least partly rotate about the rotor 120.

The rotor 120 of example locking rotary actuator 100 also includes an axial interior cavity 124 and a port 126. The port 126 is disposed to be capable of rotational alignment with the radial recess 116 and extends radially from the axial interior cavity 124 to the cylindrical exterior surface 122. For example, the rotor 120 may be rotated within the outer housing 112 to bring the port 126 into alignment with the radial recess 116.

The example locking rotary actuator 100 also includes a piston 130. The piston 130 is disposed for axially reciprocal movement within the axial interior cavity 124. For example, the cylindrical exterior surface 122 may have a generally cylindrical shape about an axis 128. The piston 130 can be configured for motion substantially parallel to the axis 128. The piston 130 is configured for motion between a first position, depicted in FIGS. 1A and 1B, and a second position that will be discussed further in the descriptions of FIGS. 2A and 2B.

The piston 130 of the example locking rotary actuator 100 includes a first portion 132 having a first thickness 133, a second portion 134 having a second thickness 135, and a piston bevel 136 extending axially from the first portion 132 to the second portion 134. The second thickness 135 is greater than the first thickness 133. As such, the piston bevel 136 forms a ramp from the first portion 132 to the second portion 134 along the axis 128.

The example locking rotary actuator 100 also includes a key 140 disposed for radially reciprocal movement, relative to the axis 128, within the port 126. The key 140 includes a radially proximal end 142 proximal relative to the axis 128 and the axial interior cavity 124, and a radially distal end 143 proximal to the exterior surface 122 and the outer housing 112. In some embodiments, multiple keys 140 may be included as necessary for increased actuator load carrying capability.

The radially proximal end 142 of the key 140 includes a first key bevel 144 that is complementary to the piston bevel 136. For example, the piston bevel 136 may extend from the first portion 132 to the second portion 134 at approximately a 45-degree (e.g., 30-60 degree) angle relative to the axis 128, and the key bevel 144 may be formed and oriented at an approximately 45 degree angle (e.g., 30-60 degrees relative to the axis 128) that approximately parallels (e.g., +/−10 degrees) the piston bevel 136.

Referring to FIG. 1B, the radially distal end 143 of the key 140 includes a pair of key bevels 145. The key bevels 145 are complementary to a pair of housing bevels 119 formed at the circumferential ends 118 of the radial recess 112. For example, the housing bevels 119 may be formed and oriented at an approximately 65 (e.g., 30-80) degree angle relative to the cylindrical interior surface 114, and the key bevels 145 may be formed and oriented at an approximately 65 (e.g., 30-80) degree angle (e.g., relative to the cylindrical interior surface 114) that approximately parallels (e.g., +/−10 degrees) the housing bevels 119.

Referring again to FIGS. 1A and 1B, the key 140 includes a body 148 extending from the radially proximal end 142 to the radially distal end 143. The radially proximal end 142 contacts the second portion 132, and as will be discussed further in the descriptions of FIGS. 2A and 2B, the radially distal end 143 is configured to not extend into the radial recess 116 when the piston 130 is in the first position, such that the radially proximal end 142 is able to contact the first portion 132.

The example locking rotary actuator 100 includes a seal 150 between the first portion 132 and a radially interior wall 129 of the axial interior cavity 124, and a seal 152 between the second portion 134 and a radially interior wall 129 of the axial interior cavity 124. The axial interior cavity 124, the first portion 132 of the piston 130, and the seal 150 partly define a pressure chamber 154, and the axial interior cavity 124, the second portion 134 of the piston 130, and the seal 152 partly define a pressure chamber 156. In some embodiments, either or both of the pressure chambers 154 and 156 can be configured to selectably apply fluid pressure to the piston 130 to urge reciprocal axial movement of the piston 130 within the axial interior cavity 124. For example, the pressure chamber 154 may be pressurized to urge the piston 130 toward the second position shown in FIGS. 2A and 2B, and/or the pressure chamber 156 may be pressurized to urge the piston 130 toward the first position shown in FIGS. 1A and 1B.

The example locking rotary actuator 100 includes an axial spring 160 in biasing contact with the piston 130. In some embodiments, the axial spring 160 can be configured to urge the piston 130 from the second position to the first position. For example, as shown in FIGS. 1A and 1B, the spring 160 is in biasing contact with the second portion 134. Fluid pressure applied to the pressure chamber 154 may be sufficient to urge the piston 130 to compress the spring 160, and when the fluid pressure is relieved the spring 160 may urge the piston back toward the first position. In some embodiments, the axial spring 160 can be configured to urge the piston 130 from the first position, shown in FIGS. 1A and 1B, to the second position, shown in FIGS. 2A and 2B. For example, the locking rotary actuator 100 may be configured with the spring 160 in biasing contact with the first portion 132 of the piston 130. Fluid pressure applied to the pressure chamber 156 may be sufficient to urge the piston 130 to compress the spring 160, and when the fluid pressure is relieved the spring 160 may urge the piston back toward the second position.

Referring to FIG. 1B, in which the piston 130 is substantially in the first position, the key 140 is able to rest substantially within the port 126. With the radially distal end 143 being below the cylindrical exterior surface 122, the rotor 120 is free to rotate substantially without mechanical interference with the outer housing 112.

Figure 2A:
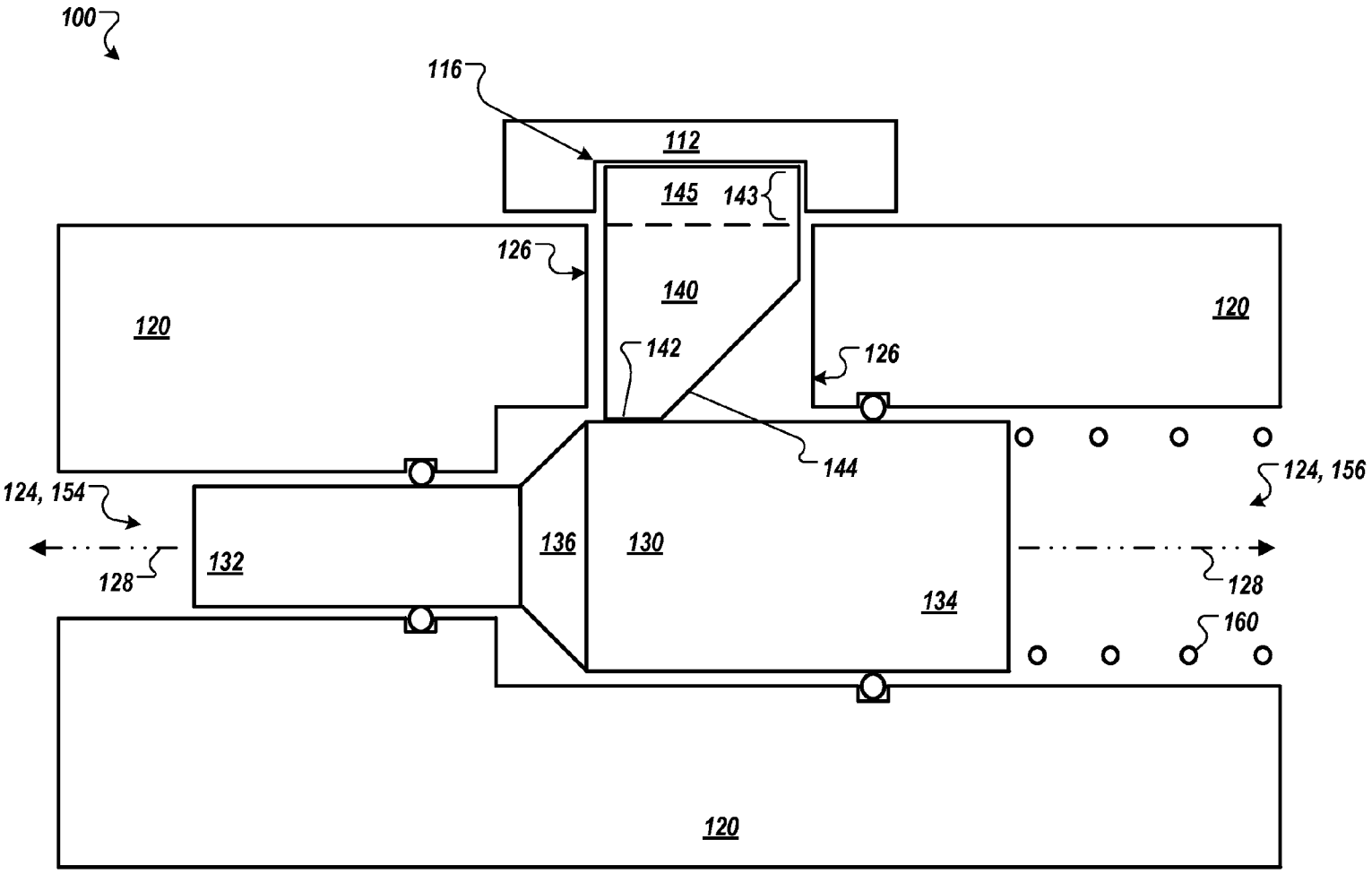
FIGS. 2A and 2B are cross-section side and end diagrams that show an example of the locking rotary actuator in a locked configuration.
Figure 2B:
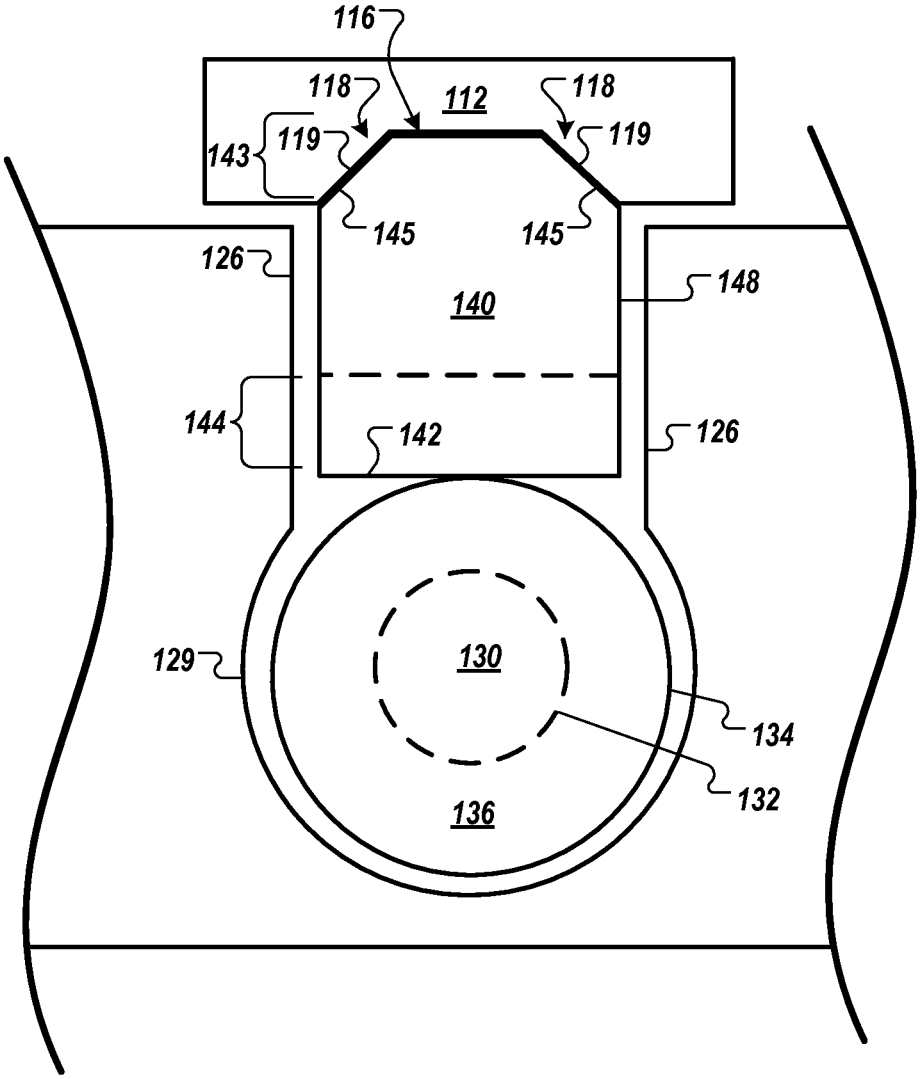

FIGS. 2A and 2B are cross-section side and end diagrams that show an example of the locking rotary actuator 100 in the second configuration (e.g., a locked configuration). In the second configuration, the piston 130 is positioned at a second position (e.g., different from the first position shown in FIGS. 1A and 1B) within the axial interior cavity 124, such that the radially proximal end 142 of the key 140 is able to contact the second portion 134 of the piston 130.

As the piston 130 is urged from the first position to the second position, complementary sliding contact between the key bevel 144 and the piston bevel 136 urges the key 140 radially away from the axis 128 though the port 126. As the key 140 moves radially along the port 126, the radially distal end 145 of the key 140 extends into the radial recess 116. With the radially distal end 145 extended into the radial recess 116, sufficient clearance is provided for the piston 130 to move substantially into the second position in which the radially proximal end 142 of the key 140 can contact the second portion 134 of the piston 130. With the piston 130 in the second position, the key 140 can be maintained in an extended position with the radially distal end 145 of the key 140 extended into the radial recess 116.

Referring to FIG. 2B, in which the piston 130 is substantially in the second position, rotation of the rotor 120 relative to the outer housing 112 causes the radially distal end 143 of the key 140 to contact and mechanically interfere with the circumferential ends 118 of the outer housing 112. The interference between the circumferential ends 118 and the radially distal end 143 of the key 140, which in turn is positioned within the port 126, substantially prevents rotation of the rotor 120 relative to the outer housing 112, reversibly "locking" the rotor 120 relative to the outer housing 112 and structures to which the outer housing 112 may be mounted. For example, the outer housing 112 may be mounted to an aircraft wing, and the rotor 120 may be connected to an aircraft control surface such as a flap. In such an example, the piston 130 may be moved to the first position to allow movement of the flap relative to the wing, and the piston 130 may be moved to the second position to substantially lock the flap into a selected position relative to the wing.

The locking rotary actuator 100 is unlocked by moving the piston 130 from the second position as shown in FIGS. 2A and 2B, back to the first position as shown in FIGS. 1A and 1B. As the piston 130 moves from the second position to the first position, the second portion 134 of the piston 130 is moved away from contact with the radially proximal end 142 of the key 140.

As discussed previously, rotation of the rotor 130 relative to the outer housing 112 causes mechanical contact between the distal end 143 of the key 140 and the radial recess 116. Referring mainly now to FIG. 2B, rotation of the rotor 130 urges at least one of the key bevels 145 into contact with the housing bevels 119. Contact between the complimentary angles of the key bevels 145 and the housing bevels 119 urges the key 140 radially inward toward the piston 130. In some implementations in which the piston 130 is in a position approximately halfway between the first position and the second position (e.g., proximal the midpoint of total travel of the piston 130), in which the piston bevel 136 can be contacted by the radially proximal end 142, rotation of the rotor 120 relative to the outer housing 112 can urge the key 140 into contact with the piston bevel. In such an example, contact between the complimentary angles of the key bevel 144 and the piston bevel 136 can urge the piston 130 axially toward the first position.

In some implementations, rotation of the rotor 120 relative to the outer housing 112 can provide mechanical energy to assist in the unlocking process, by providing at least some of the energy used to move the piston 130 from the second position to the first position. For example, rotation of the rotor 120 and the interference between the key bevels 145 and the housing bevels 119 can provide energy to urge the distal end 143 of the key 140 out of the radial recess 116. In turn, radially inward movement of the key 140 and the mechanical cooperation between the key bevel 114 and the piston bevel 136 can provide energy to urge the piston from the second position to the first position.

In some embodiments, the locking rotary actuator 100 may initially be in the second configuration until fluid pressure within the pressure chamber 154, or another appropriate force, urges the piston 130 toward the first position. In some embodiments, the locking rotary actuator 100 may initially be in the first configuration until fluid pressure is applied to the pressure chamber 156, or another appropriate force, urges the piston 130 toward the first position. For example, the spring 160 may be located proximal to the first portion 132 of the piston 130 to urge the piston toward the second position, while fluid pressure in the pressure chamber 156 may be sufficient to overcome the force of the spring 160 and urge the piston 130 toward the first position.

In some embodiments, the locking rotary actuator 100 may initially be in the first configuration until fluid pressure within the pressure chamber 154 is relieved. In some embodiments, the locking rotary actuator 100 may initially be in the second configuration until fluid pressure applied to the pressure chamber 156 is relieved, allowing the piston 130 to move toward the first position. For example, the spring 160 may be located proximal to the first portion 132 of the piston 130 and compressed by the piston 130 due to fluid pressure in the pressure chamber 156, and when that pressure is relieved the spring 160 may move the piston toward the first position.

Figure 3:
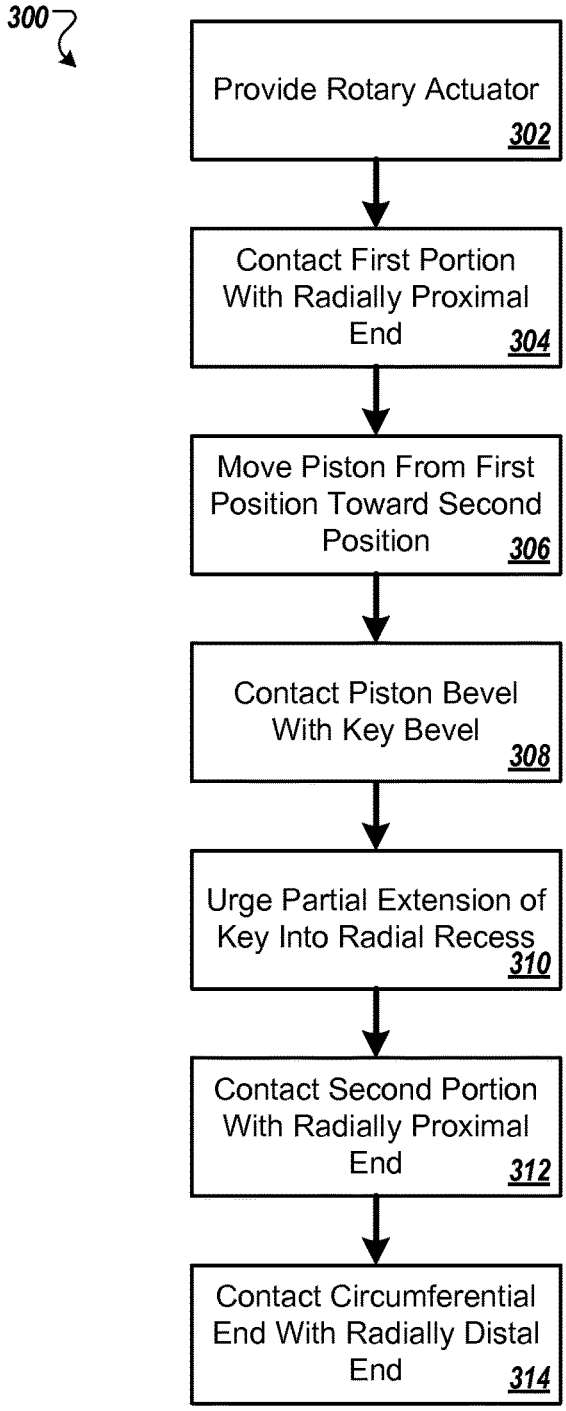
FIG. 3 is flow chart that shows an example of a process for locking a locking rotary actuator.

FIG. 3 is flow chart that shows an example of a process 300 for locking a locking rotary actuator. In some implementations, the process 300 can be used with the locking rotary actuator 100 of FIGS. 1A-2B.

At 302, a locking rotary actuator is provided. For example, the locking rotary actuator 100 can be provided.

At 304, the first portion is contacted with the radially proximal end. For example, the first portion 132 of piston 130 can be contacted with the radially proximal end 142 of key 140.

At 306, the piston is moved by an external force from the first position toward the second position. For example, fluid pressure can be applied to the pressure chamber 154 to urge the piston 130 from the first position shown in FIGS. 1A and 1B toward the second position shown in FIGS. 2A and 2B.

At 308, the piston bevel is contacted with the key bevel. For example the piston bevel 136 can be contacted by the key bevel 144.

At 310 movement of the piston and contact between the first key bevel and the piston bevel urges partial radial extension of the key through the port and partial extension of the radially distal end into the radial recess. For example, as the piston 130 is moved from the first position toward the second position, the piston bevel 136 contacts the key bevel 144, urging the key 140 to extend radially away from the piston 130. As the key 140 extends radially, the radially distal end 143 of the key 140 extends into the radially recess 116.

At 312, the second portion is contacted with the radially proximal end, preventing radial retraction of the key through the port and escapement of the radially distal end from the radial recess. For example, when the radially proximal end 142 of the key 140 is in contact with the second portion 134 of the piston 130, the key 140 is substantially unable to move radially inward to allow the radially distal end 143 of the key 140 from escaping the radial recess 116.

At 314, the circumferential end is contacted by the radially distal end. For example, the rotor 120 can be fractionally rotated relative to the outer housing 112, causing the radially distal end 143 of the key 140 to contact one of the circumferential ends 118. Mechanical interference between the radially distal end 143 of the key 140 and the circumferential ends 118 can prevent further rotation of the rotor 120 relative to the outer housing 112, substantially "locking" the rotor 120 in place relative to the outer housing 112.

Figure 4:
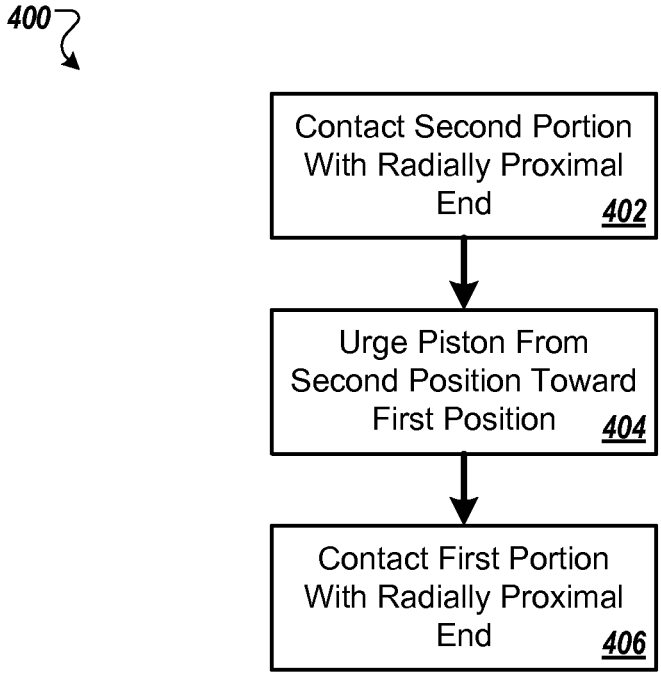
FIG. 4 is flow chart that shows an example of a process for unlocking a locking rotary actuator.

FIG. 4 is flow chart that shows an example of a process 400 for unlocking a locking rotary actuator. In some implementations, the process 400 can be used with the locking rotary actuator 100 of FIGS. 1A-2B.

At 402, the second portion is contacted with the radially proximal end. For example, the second portion 134 of the piston 130 can be contacted by the radially proximal end 142 of the key 140.

At 404, the piston is urged by an external force from the second position toward the first position, allowing radial retraction of the key through the port and escapement of the radially distal end from the radial recess. For example, fluid pressure applied to the pressure chamber 154 can urge the piston 130 to move toward the first position. In other examples, the spring 154 may be located proximal to the first portion to provide a force that can move the piston from the second position toward the first position. As the piston 130 moves toward the first position, the key 140 can move radially inward within the port 126 and allow the radially distal end 143 of the key 140 to escape the radial recess 116.

In some implementations, the housing can be rotated relative to the rotor, the key, and the piston, and one of the circumferential ends can be contacted to a complementary one of the second key bevels. For example, the one of the key bevels 145 can be brought into contact with a corresponding one of the housing bevels 119. In some implementations, contact between the circumferential end to the complimentary one of the second key bevels can urge radial retraction of the key through the port and ejection of the radially distal end from the radial recess. For example, relative rotary motion between the key and the outer housing can cause the complimentary angles of the housing bevel 119 and the key bevel 145 to transform some of the rotary force into radial force that can urge the key radially inward such that the radially distal end 143 of the key 140 is ejected from the radial recess 116. In some implementations, the piston bevel can be contacted with the key bevel, and contact between the key bevel and the piston bevel can urge movement of the piston from the second position to the first position. For example, inwardly radial movement of the key 140 can be transformed into axial movement of the piston 130 by contact between the complimentary angles of the key bevel 144 and the piston bevel 136.

At 406, the first portion 132 is contacted with the radially proximal end 142. For example, the radially proximal end 142 of the key 140 can contact the second portion 132 of the piston 130 when the piston 130 is in the first position, as shown in FIGS. 1A and 1B.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A locking apparatus for a rotary actuator, comprising:
an outer housing comprising a cylindrical interior surface having a radial recess having at least one circumferential end formed therein;
a rotor disposed within the outer housing and comprising;
a cylindrical exterior surface rotatable within the cylindrical interior surface;
an axial interior cavity; and
a port disposed to be capable of rotational alignment with the radial recess and extending radially from the axial interior cavity to the cylindrical exterior surface; and,
a piston disposed for axially reciprocal movement within the axial interior cavity between a first position and a second position and comprising:
a first portion having a first thickness;
a second portion having a second thickness larger than the first thickness; and
a piston bevel extending axially from the first portion to the second portion; and,
a key disposed for radially reciprocal movement within the port and comprising:
a radially proximal end having a first key bevel complementary to the piston bevel; and,
a radially distal end; and
a body extending from the radially proximal end to the radially distal end such that the radially proximal end contacts the second portion and the radially distal end extends into the radial recess when the piston is in the second position, and the radially proximal end contacts the first portion and the radially distal end does not extend into the radial recess when the piston is in the first position.

2. The rotary actuator of claim 1, wherein the circumferential end has a housing bevel extending circumferentially radially angled from the radial recess to the cylindrical interior surface, and the radially distal end has at least one second key bevel complementary to the housing bevel.

3. The rotary actuator of claim 1, further comprising an axial spring in biasing contact with the piston.

4. The rotary actuator of claim 3, wherein the axial spring is configured to urge the piston into the first position or the second position.

5. The rotary actuator of claim 1, wherein the piston further comprises at least one seal between at least one of the first portion and a radially interior wall of the axial interior cavity, and the second portion and the radially interior wall of axial interior cavity.

6. The rotary actuator of claim 5, further comprising a pressure chamber defined by the axial interior cavity, the piston, and the seal, the pressure chamber being configured to selectably apply fluid pressure to the piston to urge reciprocal axial movement of the piston within the axial interior cavity.

7. A method for selectively locking a rotary actuator, comprising:
providing a rotary actuator, comprising:
an outer housing comprising a cylindrical interior surface having a radial recess having at least one circumferential end formed therein;
a rotor disposed within the outer housing and comprising;
a cylindrical exterior surface rotatable within the cylindrical interior surface;
an axial interior cavity; and
a port disposed to be capable of rotational alignment with the radial recess and extending radially from the axial interior cavity to the cylindrical exterior surface; and,
a piston disposed for axially reciprocal movement within the axial interior cavity between a first position and a second position and comprising:
a first portion having a first thickness;
a second portion having a second thickness larger than the first thickness; and
a piston bevel extending axially from the first portion to the second portion; and,
a key disposed for radially reciprocal movement within the port and comprising:
a radially proximal end having a first key bevel complementary to the piston bevel; and,
a radially distal end; and
a body extending from the radially proximal end to the radially distal end such that the radially proximal end contacts the second portion and the radially distal end extends into the radial recess when the piston is in the second position, and the radially proximal end contacts the first portion and the radially distal end does not extend into the radial recess when the piston is in the first position;
contacting the first portion with the radially proximal end;
moving, by an external force, the piston from the first position toward the second position;
contacting the piston bevel with the key bevel;
urging, by movement of the piston and contact between the first key bevel and the piston bevel, partial radial extension of the key through the port and partial extension of the radially distal end into the radial recess;
contacting the second portion with the radially proximal end, preventing radial retraction of the key through the port and escapement of the radially distal end from the radial recess; and
contacting, by the radially distal end, the circumferential end.

8. The method of claim 7, further comprising:
contacting the second portion with the radially proximal end;
urging, by an external force, the piston from the second position toward the first position, allowing radial retraction of the key through the port and escapement of the radially distal end from the radial recess; and
contacting the first portion with the radially proximal end.

9. The method of claim 8, wherein the at least one of the circumferential ends has a housing bevel extending circumferentially radially angled from the radial recess to the cylindrical interior surface, and the radially distal end has at least one second key bevel complimentary to the housing bevel, and the method further comprises:

rotating the housing relative to the rotor, the key, and the piston;

contacting one of the circumferential ends to a complementary one of the second key bevels;

urging, by the contact between the circumferential end to the complimentary one of the second key bevels, radial retraction of the key through the port and ejection of the radially distal end from the radial recess;

contacting the piston bevel with the key bevel; and urging, by contact between the key bevel and the piston bevel, movement of the piston from the second position to the first position.

10. The method of claim 7, wherein the rotary actuator further comprises an axial spring in biasing contact with the piston.

11. The method of claim 10, wherein the axial spring is configured to urge the piston into the first position or the second position.

12. The method of claim 7, wherein the piston further comprises at least one seal between at least one of the first portion and the axial interior cavity, and the second portion and the axial interior cavity.

13. The method of claim 5, wherein the rotary actuator further comprises a pressure chamber defined by the axial interior cavity, the piston, and the seal, the pressure chamber being configured to selectably apply fluid pressure to the piston to urge reciprocal axial movement of the piston within the axial interior cavity.

14. The method of claim 13, wherein moving the piston from the first position toward the second position comprises applying a fluid pressure to the pressure chamber.

15. The method of claim 13, wherein moving the piston from the first position toward the second position comprises relieving a fluid pressure within the pressure chamber.

* * * * *